United States Patent [19]

Wagar

[11] 4,410,094

[45] Oct. 18, 1983

[54] RECORD STORAGE APPARATUS

[76] Inventor: Robert L. Wagar, 8189 W. Carpenter Rd., Flushing, Mich. 48433

[21] Appl. No.: 215,075

[22] Filed: Dec. 10, 1980

Related U.S. Application Data

[63] Continuation-in-part of Ser. No. 90,515, Nov. 2, 1979, Pat. No. 4,305,520.

[51] Int. Cl.[3] ..... A47F 5/00

[52] U.S. Cl. ..... 211/55; 220/22.1

[58] Field of Search ..... 211/50, 55, 10, 11, 211/40; 220/22.5, 22.1, 20; 229/69

[56] References Cited

U.S. PATENT DOCUMENTS

| | | | |
|---|---|---|---|
| 193,296 | 7/1877 | Thomas . | |
| 580,899 | 4/1897 | Roberts . | |
| 1,194,536 | 8/1916 | Oliver . | |
| 1,684,842 | 9/1928 | Morse . | |
| 1,712,168 | 5/1929 | Rand, Jr. . | |
| 2,169,562 | 8/1939 | Lombardini . | |
| 3,023,907 | 3/1962 | Ross | 211/55 |
| 3,489,332 | 1/1970 | Knittel | 229/68 R X |
| 3,524,688 | 8/1970 | Dean | 312/184 |
| 3,917,105 | 11/1975 | Lambert et al. | 220/22 |

FOREIGN PATENT DOCUMENTS

| | | | |
|---|---|---|---|
| 1397129 | 3/1970 | United Kingdom . | |
| 2034579 | 6/1980 | United Kingdom | 211/55 |

*Primary Examiner*—Ramon S. Britts
*Assistant Examiner*—Robert W. Gibson, Jr.
*Attorney, Agent, or Firm*—Basile, Weintraub & Hanlon

[57] ABSTRACT

A storage apparatus for removably receiving planar members, such as business records. The storage apparatus comprises a storage container having front and rear wall portions and a pair of spaced rods extending horizontally therebetween. A file envelope is adapted to be removably inserted into the storage container. The file envelope is formed with front and rear upstanding walls, each including an aperture located along the side edge. The apertures engage the pair of spaced rods in the storage container to enable the file envelope to be placed on and slidingly supported by the rods. Removable securing members are placed along the side edges of the file envelope to secure the file envelope on the rods in the storage container. In another embodiment, the apertures are located along the bottom edge of the envelopes such that the envelopes are supported on the top of the rods. The rear wall of each envelope has a greater height than its corresponding front wall and is joined to the front wall of the adjacent envelope to form a step-up arrangement.

6 Claims, 7 Drawing Figures

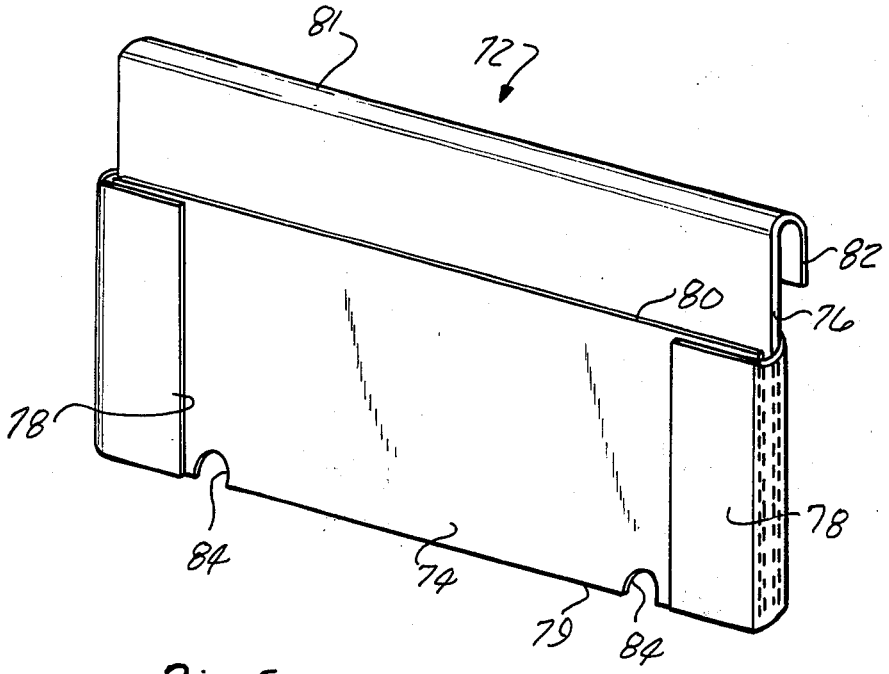
Fig-5
Fig-6
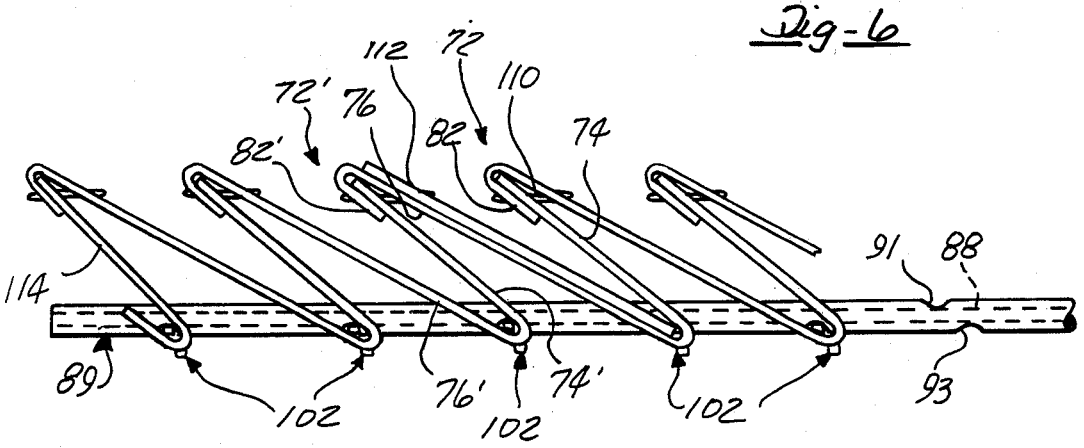

RECORD STORAGE APPARATUS

CROSS-REFERENCE TO CO-PENDING APPLICATION

This application is a continuation-in-part of co-pending application, Ser. No. 090,515, filed Nov. 2, 1979, now U.S. Pat. No. 4,305,520, in the name of Robert L. Wagar and entitled "RECORD STORAGE APPARATUS".

BACKGROUND OF THE INVENTION

1. Field of the Invention

This invention relates, in general, to record keeping and, more specifically, to storage apparatus for storing a group of records.

2. Description of the Prior Art

In the modern business world, the efficient storage of business forms, such as letters and records, is essential to efficient organization and operation of the business. In achieving such efficiency, the business records must be stored in as compact a manner as possible and yet, at the same time, allow for easy retrieval during daily business operations. This is especially critical in storing small rectangular cards indicia of computer programs or the so-called magnetic cards utilized by modern word processing equipment. Such types of business records must be retained in groups, with the cards in each group maintained in a predetermined order.

It is common to store these types of business records in standard file drawers formed with front, rear, side and bottom portions and an open top. The cards are arranged in the desired groups and order and disposed in a vertical upstanding manner within the drawer. However, problems of quick identification and retrieval of a desired group of cards is difficult in standard file drawer arrangements, as well as maintaining the cards in a vertical orientation to prevent damage to the cards and to permit more compact storage.

A variety of filing apparatus, including file drawers and file dividers or envelopes, are well known to the skilled artisan. Such apparatus includes a bill file disclosed in U.S. Pat. No. 193,296 wherein a plurality of dividers are positioned within a file drawer. The dividers having notches in the sides thereof which engage a pair of strips disposed along the horizontal sides of the drawer. Papers or other records are placed between the dividers if desired, with the dividers being slidingly movable along the strip so as to accommodate different numbers of papers or records therebetween.

It is also known to provide dividers which include apertures at the top end thereof which engage horizontally extending strips in the side of a file drawer to hold the file in a vertical upright position and to permit sliding movement of file dividers within the drawer, as shown in U.S. Pat. No. 1,712,168.

However, such file or record keeping apparatus are difficult to use with the small rectangular cards. In the first instance, no means are provided for maintaining the cards securely together in a predetermined order between the dividers so as to permit easy and quick retrieval of an entire group of cards or records. In the latter apparatus, the horizontal rods must be removed from the drawer to permit removal of the file dividers from the drawer for rearrangement of the file system.

Thus, it would be desirable to provide a storage apparatus for business records which overcomes the problems associated with prior art filing apparatus in storing business records or documents. It would also be desirable to provide a film storage apparatus which maintains the business records together in a group and in predetermined order within each group so as to facilitate easy removal of a group of records from the file drawer. It would be desirable to provide a storage apparatus which protects the business records contained therein from damage and which maintains the records in a vertical position within the storage apparatus. Finally, it would be desirable to provide a record storage apparatus in which the file envelopes are arranged such that a portion of the records stored therein are exposed for ease in identification.

SUMMARY OF THE INVENTION

There is disclosed herein a new and improved storage apparatus adapted to receive planar members such as business records. The storage apparatus comprises a storage container having front and rear portions and a pair of spaced rods extending substantially horizontally therebetween. A file envelope is formed with front and rear upstanding walls each having top, bottom and opposed side portions. Preferably, the side and bottom portions of the front and rear walls of the file envelope are joined together to form a continuous enclosure having an open top to receive a plurality of planar members, such as rectangular cards or records therein. The file envelope includes a pair of apertures located along the side portions thereof. The apertures have an open end which engages the pair of spaced rods in the storage container so as to enable the file envelope to be placed on and supported by the rods for sliding movement therealong. The file envelope of this invention further includes means for removably securing the file envelope on the rods. The securing means comprises a substantially U-shaped member having first and second depending legs. The securing member is disposed over the file envelope and placed adjacent the side portion of the file envelope between the rod disposed in the aperture and the side edge of the envelope so as to secure the envelope on the rods and yet permit sliding movement of the file envelope therealong.

In another embodiment, a record storage apparatus is disclosed in which the file envelopes are arranged in a step-up manner to expose a portion of the records contained therein for ease of identification. In this embodiment, the apertures are located along the bottom edges of the front and rear walls of the envelopes such that the envelopes are supported on top of the rods. Also, the rear wall has a greater height than its corresponding front wall and is joined to the front wall of the rearward adjacent envelope. The rear wall of the last envelope is secured to the support frame or to the rods in such a manner so as to dispose the top edges of the envelopes at a predetermined acute angle with respect to the bottom edges thereof. This creates a step-up arrangement of the envelopes which exposes the top portion of the records contained therein for ease of identification.

In addition to enhancing identification of the records stored within each envelope, the record storage apparatus of this invention can be uniquely arranged in a vertical orientation. This permits its use in many different record storage applications.

BRIEF DESCRIPTION OF THE DRAWING

The various features, advantages and other uses of this invention will become more apparent by referring to the following detailed description and drawing in which:

FIG. 5 is a perspective view of a file drawer constructed for use with the record storage apparatus illustrated in FIG. 4;

FIG. 6 is a cross-sectional view, generally taken along lines 6—6 in FIG. 4.

DESCRIPTION OF THE PREFERRED EMBODIMENTS

Figure 1:
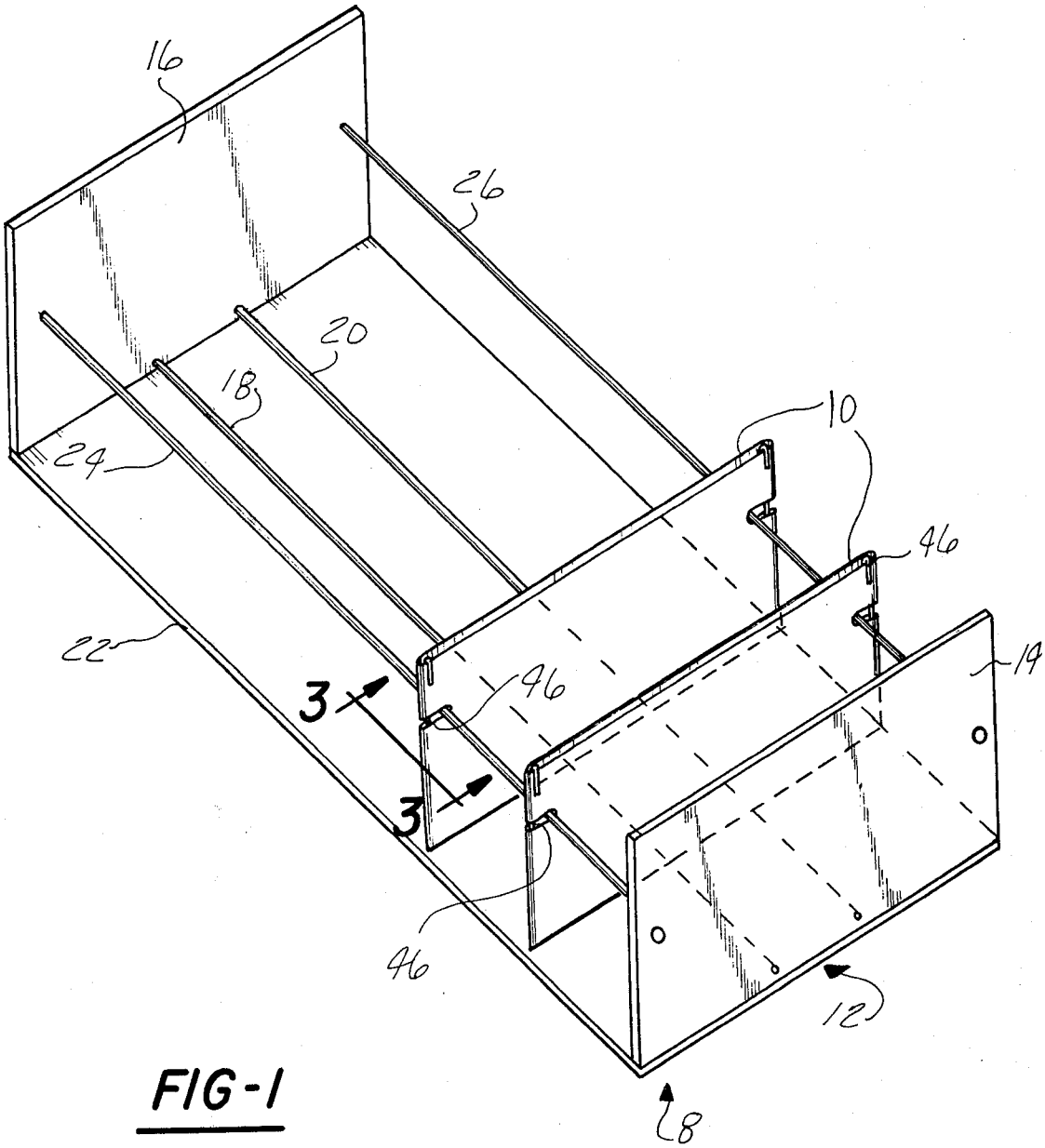
FIG. 1 is a perspective view of a file envelope adapted to be removably inserted in a file drawer.

Throughout the following description, identical reference numbers are used to refer to the same component or member shown in multiple figures of the drawing.

Figure 2:
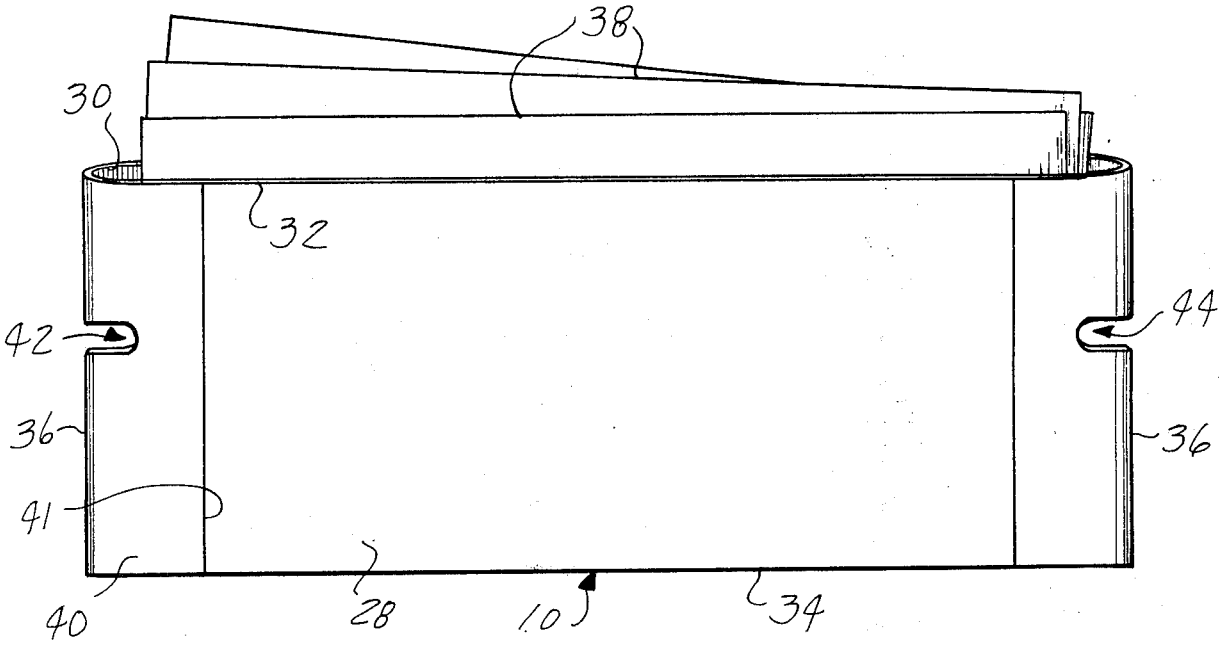
FIG. 2 is a perspective view of a file envelope constructed according to the teachings of this invention.

Referring now to the drawing and, in particular, to FIGS. 1 and 2, there is shown a storage apparatus 8 comprising a file envelope or divider 10 and a storage container 12.

The storage container 12 is an enclosure formed with spaced front and rear portions 14 and 16, respectively. The front and rear walls 14 and 16 are spaced apart and supported by a bottom portion 22. Side walls, not shown, may also be provided if desired, to form a continuous enclosure around the business records. Thus, the storage container 12 forms an enclosure having an open top.

The storage container 12 may be a rack which can be portable so as to be easily placed on top of a desk or table or moved around where it is needed within an office. It may also be utilized to provide a convenient method for transporting business records from place to place. In this application, a suitable handle and cover may be provided. Further, the storage container may also be formed in a conventional drawer-like configuration so as to be slidably stacked in a cabinet when not is use.

The storage container 12 further includes a pair of spaced guide rods 24 and 26 which extend substantially horizontally between the front and rear portions 14 and 16, respectively, of the container 12 and which are disposed about the bottom 22 of the container 12. The guide rods 24 and 26 may be of any convenient shape, such as circular or rectangular, so as to facilitate the sliding movement of the file envelope 10 therealong, as described in greater detail hereafter.

The file envelope 10, is suitably formed to removably receive a plurality of cards or records and is dimensioned so as to suit a wide variety of applications. Preferably, the file envelope 10 is formed of heavy paper so as to provide a rigid enclosure which surrounds and protects the cards or records inserted therein. Although paper is preferred, any suitable material may be utilized to form the file envelope 10 of this invention.

The file envelope 10 is formed by any conventional means, such as by blanking or cutting a suitably dimensioned blank from sheet material. The blank is then folded to form front and rear wall portions 28 and 30, respectively, as shown more clearly in FIG. 2. The front and rear wall portions 28 and 30 are substantially upstanding and include top, bottom and side portions or edges 32, 34 and 36, respectively.

Although the file envelope 10 has been described as being formed of a folded blank, the bottom portion of the file envelope 10 may also be formed by suitably attaching or joining together separate front and rear wall portions 28 and 30 to form a closed surface which supports the plurality of cards or records shown generally by reference number 38 in FIG. 2 therein.

The file envelope 10 further includes means 40 for securing or fixing the side edges or portions 36 of the front and rear wall portions 28 and 30 together to form a continuous enclosure having an open top end for receiving a plurality of rectangular cards 38. Preferably, the securing means 40 comprises adhesive tape 41 which is disposed around the side portions 36 of the front and rear wall portions 28 and 30 so as to secure the front and rear wall portions 28 and 30 together at the side edges 36 thereof. Although adhesive tape has been described and illustrated, it will be noted that any conventional attaching or fastening means may be utilized to join the side edges of the file envelope 10 together to form a continuous enclosure for the business records.

As noted above, the file envelope 10 is suited for use in removably receiving a plurality of rectangular records 38 therein. More specifically, the file envelope 10 is dimensioned so as to receive a plurality of rectangular cards 38 wherein the rectangular cards 38 consists of standard sized computer cards or magnetic cards utilized with word processing equipment. Thus, the cards 38 have a rectangular configuration and are approximately three inches by seven inches in size. It will also be noted that the dimensions of the storage container 12 may be altered so as to adapt the file envelope 10 of this invention to receive a wide variety of different configured papers or cards. Thus, the dimensions of the file envelope 10 and the storage container 12 may be chosen to provide storage for the substantially square magnetic floppy discs, as well as conventional papers and letters.

As shown in FIG. 2, the file envelope 10 includes a pair of opposed apertures 42 and 44 which are formed adjacent the side edges 36 of the file envelope 10 in both the front and rear wall portions 28 and 30. The apertures 42, which preferably comprise a horizontally-extending slot, have an open end at the side edge 36 of the file envelope 10. The height of the apertures 42 and 44 is chosen so as to permit the bottom portion 34 of the file envelope 10 to be in proximity on the bottom 23 of the storage container 12 when the file envelope 10 is inserted in the container 12 and the apertures 42 and 44 engage the guide rods 24 and 26 respectively. Alternately, a second pair of spaced rods 18 and 20 may be provided adjacent the bottom 22 of the container 12, as shown in FIG. 1, to minimize wear and abrasion on the bottom of the file envelopes 10 caused by frequent sliding movement of the file envelopes 10 along the guide rods 24 and 26.

As noted above, the apertures 42 and 44 function to permit the file envelope 10 to be removably inserted on the guide rods 24 and 26 within the container 12, such that the file envelope 10 is placed upon and slidingly supported on the guide rods 24 and 26 thereby facilitating easy insertion and removal of the file envelope 10 in the container 12.

Figure 3:
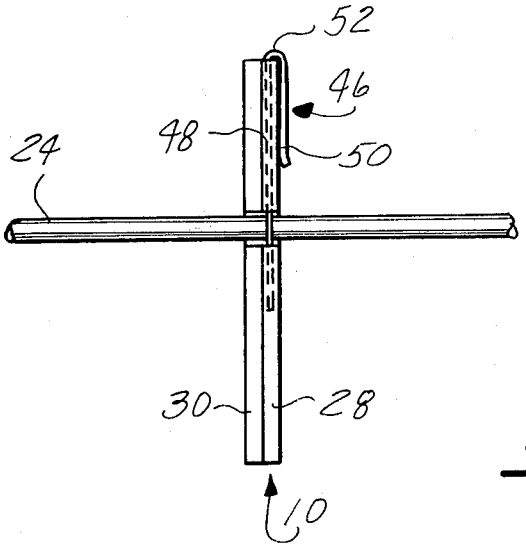
FIG. 3 is a side view of the securing means utilized to maintain the file envelope on the guide rods in the file drawer as shown in FIG. 1.

As shown in FIG. 1, and in greater detail in FIG. 3, the file envelope 10 of this invention further includes means, denoted generally by reference number 46, for releasably securing the file envelope 10 on the guide rods 24 and 26. Preferably the securing means 46 is inserted along the side portions or edges 36 of the file envelope 10 after the envelope 10 has been inserted within the container 12 and the apertures 42 and 44 engage the guide rods 24 and 26. The securing means 46 is inserted between the guide rods 24 and 26 in the apertures 42 and 44, as shown in FIG. 1, and the side edge 36 of the file envelope 10 so as to secure the file envelope 10 on the guide rods 24 and 26 and, at the same time, allow sliding movement of the file envelope 10 along the guide rods 24 and 26.

Preferably, the securing means 46 comprises a substantially U-shaped member having first and second depending legs 48 and 50 respectively, which are joined together at a common end 52. The legs 48 and 50 may be of the same length as shown on one of the legs 48 and 50 may be smaller than the other to facilitate the insertion of the securing means 46 over envelope 10. The securing means 46 is preferably formed of a resilient material, such as spring steel, so as to exert a spring or clamping force on the file envelope 10 and thereby retain the same on the guide rods 24 and 26.

In use, the securing means 46 is inserted between the guide rod 24 or 26 and the side edge 36 of the file envelope 10 such that the first and second depending legs 48 and 50 are disposed over one of the front or rear walls 28 and 30 of the file envelope 10, such as the front wall 30, as shown in FIG. 3. In this manner, the securing means 46 secures the file envelope 10 on the guide rods 24 and 26 and is easily removed therefrom to permit the complete removal of the file envelope 10 from the file drawer 12.

Referring now to FIGS. 4–7, there is disclosed a record storage apparatus constructed according to another embodiment of this invention. The record storage apparatus 70 functions to dispose a plurality of file envelopes in either a horizontal or substantially vertical orientation.

Referring briefly to FIG. 5, there is depicted a file envelope 72. The file envelope 72 is constructed from planar sheet material, which may be in the form of a blank which is cut to the desired shape for storing records or other documents. The blank is folded along an intermediate portion thereof to form front and rear upstanding walls 74 and 76, respectively. The front and rear walls 74 and 76 are integrally formed along the bottom edge 79 thereof; although separate sheets may be joined together along the bottom edge to form the file envelope 72 as well.

Means 78 for securing the sides of the front and rear walls 74 and 76 together is provided. Preferably, the means 78 comprises a strip of adhesive tape which is applied adjacent the side edges of the front and rear walls 74 and 76 so as to form a continuous enclosure having an open top adapted to receive planar records or documents. Although tape is disclosed as comprising the securing means, other suitable fastening methods, such as the use of staples or adhesives, may also be utilized to join the side edges of the front and rear walls 74 and 76 of the file envelope 72 together.

As shown in FIG. 5, the height of the rear wall 76 is higher than the height of the corresponding front wall 74 such that the top edge 81 of the rear wall 76 extends upward beyond the top edge 80 of the front wall 74. The rear wall 76 is further formed with a downward extending lip or flange 82, the purpose of which will be described in greater detail hereafter.

Further, the front and rear walls 74 and 76 have formed therein a pair of spaced apertures 84. The apertures 84 are situated along the bottom edge 79 of the front and rear walls 74 and 76. Preferably, the apertures are in the form of a substantially vertically extending slot having an open end along the bottom edge 79 of the envelope 72.

Figure 4:
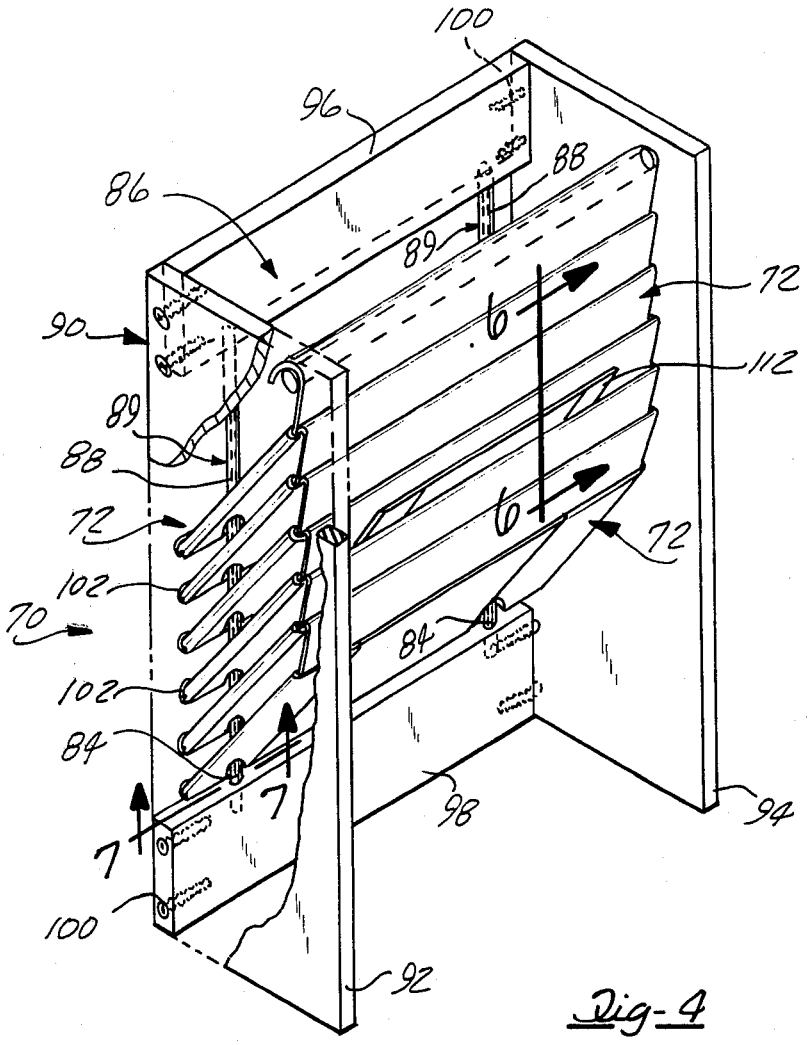
FIG. 4 is a perspective view of a record storage apparatus constructed according to another embodiment of this invention.

The record storage apparatus 70 of this invention further includes means, denoted generally at reference number 86 in FIG. 4, for supporting the envelopes 72 in a linear array. The supporting means comprises a pair of spaced rods 88. The rods 88, which may be formed of any suitable material, cooperate with the apertures 84 in the file envelope 72 such that the file envelope 72 is supported on top of the rods 88.

A suitable frame assembly 90 is provided for supporting the file envelopes 72 in the linear array. The frame assembly 90 includes a pair of spaced side walls 92 and 94 which are interconnected by means of end pieces 96 and 98. The side walls 92 and 94 are joined to the end pieces 96 and 98 by any conventional fastening means, such as screws 100. The rods 88 are securely joined to the end pieces 96 and 98 and are maintained in the same plane.

Although a frame assembly 90 is illustrated for supporting the rods 88 in the file envelopes 72, such an illustration is by way of example only and not limitation. The use of such a frame 90 provides a degree of portability to the record storage apparatus 70 of this invention. However, it is also contemplated that the rods 88 may be incorporated into a rigid structure not having spaced side walls 92 and 94 as does the frame assembly 90.

Figure 7:
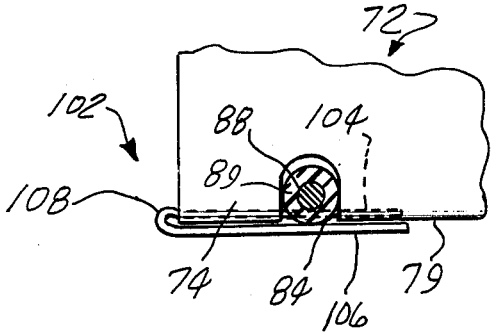
FIG. 7 is a partial elevational view showing the mounting of the file envelope in the record storage apparatus illustrated in FIG. 4.

Means, denoted generally by reference number 102 in FIG. 7, are provided for removably securing the file envelopes 72 on the support rods 88. Preferably, the securing means 102 comprises a substantially U-shaped member having a first and second spaced legs 104 and 106 which are integrally joined together at a common end 108. The securing means 102 is formed of a suitable material having resilient characteristics so as to exert a clamping force on the file envelope 72 and the rods 88 in order to maintain the file envelope 72 positioned on the rods 88.

As depicted in FIG. 7, the securing means 102 is inserted along the bottom edge of the file envelope 72 such that the first leg 104 thereof extends inward between the opposed front and rear walls 74 and 76 of the file envelope 72; while the second leg 106 extends exteriorly along the bottom edge 79 of the front and rear walls 74 and 76. In such a location, the legs 104 and 106 of the securing means 102 hold the file envelope 72 in secure position on the support rod 88. Further, the securing means 102 may be removed simply by pulling it outward from the file envelope 72 in order to enable the file envelope 72 to be removed from the record storage apparatus 70 of this invention.

Referring now to FIG. 6, there is illustrated a cross-sectional view showing the arrangement of a plurality of file envelopes 72 within the record storage apparatus 70 of this invention. Each file envelope 72 is shown in a slightly expanded state so as to clarify the features of the invention. As shown therein a plurality of file envelopes, such as file envelopes 72 and 72', are arranged in a linear arrangement along the rods 88, with each file envelope 72 being secured to the rods 88 by means of the securing means 102.

According to this embodiment of the invention, the rear wall of each file envelope, such as rear wall 76 of the file envelope 72, is joined to the front wall of the rearward adjacent file envelope, such as front wall 74' of file envelope 72'. The rear wall 76 may be joined to front wall 74' by any conventional fastening means, denoted generally by reference number 110. The fastening means 110 may be in the form of a staple, adhesive, or the like.

The top edges of the rear wall 76 and the front wall 74' may be aligned before being joined together. However, it is preferred that the rear wall 76 of each file envelope be formed with a depending flange portion 82. In this manner, the depending flange portion 82 surrounds the top portion of the front wall 74' adjacent rearward filed envelope 72' and is secured thereto by staples 110.

Means 114 are also provided for disposing the file envelopes at a predetermined angle with respect to the rods 88 so as to expose the top portion of the records 112, in FIG. 4, stored in each file envelope for ease of identification. Preferably the disposing means 114 comprises a short planar spacer sheet which is disposed at the end of a group of file envelopes 72. The sheet 114 includes a pair of spaced apertures, not shown, corresponding to the apertures 84 in the other file envelopes 72. In addition, the sheet 114 is secured onto the support rods 88 by means of the securing means 102 in a like manner as the other file envelopes 72.

The top edge of the sheet 114 is joined to the rear wall of the last file envelope. Due to the relatively short height of the sheet 114 the remaining file envelopes 72 are disposed at a predetermined acute angle with respect to the rods 88 or the bottom edge 79 of each envelope 72 such that the top portion of records stored within each file envelope are exposed to view.

Alternately, the disposing means 114 may be in the form of a rod, not shown, which extends between the side walls 92 and 94 of the frame assembly 90 illustrated in FIG. 4. The depending flange 82 of the last file envelope 72 may then be disposed around the rod and secured to the rear wall in order to fix the group of file envelopes 72 at the predetermined acute angle.

As shown in FIG. 6, the rods 88 are covered by a thin layer 89 of a suitable plastic material. A series of notches or grooves are formed on opposed sides of the plastic layer 89 and are offset with respect to each other, such as grooves 91 93. The grooves serve to enhance the angular orientation of the file envelopes 72 since one leg of the fastening means nests within a groove such as groove 93, on the bottom side of the rod; while the rear wall of each envelope nest within the offset groove on the top side of the rod. In this way, the file envelopes 72 are held securely in the desired angular orientation.

It should also be noted that the grooves may be formed directly in the rods 88, thereby eliminating the need for the plastic layer 89.

In use, the record storage apparatus 70 of this invention may be employed in a horizontal orientation within a conventionally formed file drawer. In addition, the record storage apparatus 70 may be oriented in a vertical orientation, as viewed in FIG. 4. In this type of orientation, it is preferred that the rods or frame assembly supporting the file envelopes be disposed at a slight backward angle from vertical such that the cards or records stored within each envelope are disposed at a vertical position to further enhance the identification of the stored records. As noted previously, the record storage apparatus may incorporate a frame assembly for supporting the file envelopes and to provide a degree of portability to the entire record storage apparatus. Further, the rods supporting the file envelopes may be incorporated into a rigid frame assembly so as to support a group of file envelopes by themselves.

What is claimed is:

1. A record storage apparatus comprising:
a plurality of envelopes, each of said envelopes having upstanding front and rear walls, with top, bottom and side edges;
said rear wall of each envelope having a greater height than said corresponding front wall;
said rear wall of each envelope being joined to said front wall of the adjacent rearward envelope;
means for disposing said top edge of said envelopes at a predetermined acute angle with respect to said bottom edges thereof; and
means for supporting envelopes in a linear arrangement, said supporting means including:
a pair of spaced, parallel rods;
said envelopes having a pair of spaced apertures located along the bottom edges of said front and rear walls, said apertures adapted to be disposed around said rods such that said envelopes are supported on said rods; and
means for securing said envelopes on said rods.

2. The record storage apparatus of claim 1 wherein the securing means is a substantially U-shaped member having first and second legs integrally joined at one end;
said securing means adapted to be inserted from the side edge of the envelope such that said first leg extends inward between the front and rear walls of said envelope and said second leg extends exteriorly along the bottom edge of said envelope such that said first and second legs retain said envelope on the rod.

3. The record storage apparatus of claim 1 further including means for joining the side edges of the front and rear walls of each envelope together to form a continuous enclosure having an open top for receiving planar articles therein.

4. The record storage apparatus of claim 4 wherein the joining means is an adhesive tape disposed around the side edges of the front and rear walls.

5. The record storage apparatus of claim 1 wherein the rear wall of each envelope is formed with a depending flange portion;
said depending flange portion being adapted to be disposed over the top edge of the front wall of the adjacent rearward envelope and secured thereto.

6. The record storage apparatus of claim 1 wherein the disposing means comprises:
a planar sheet having a height substantially less than the height of the front wall of the envelopes;
said planar sheet being disposed rearward of the rearmost of the plurality of said envelopes and supported on the supporting means;
said planar sheet being connected to the rear wall of said rearmost envelope so as to dispose the top edge of said plurality of envelopes at a predetermined acute angle with respect to said bottom edges thereof.

* * * * *